United States Patent [19]

Newman

[11] 4,039,788

[45] Aug. 2, 1977

[54] ELECTRICAL CONNECTOR AND SWITCH APPARATUSES

[76] Inventor: Peter Newman, Roslin, 23 Springfield Road Bishopbriggs, Glasgow, Scotland

[21] Appl. No.: 656,125

[22] Filed: Feb. 9, 1976

[51] Int. Cl.[2] ..... H01R 33/28

[52] U.S. Cl. ..... 200/51.13; 200/16 B; 200/163

[58] Field of Search ..... 200/51.07, 51.08, 51.13, 200/16 B, 163, 16 C, 16 D, 307

[56] References Cited

U.S. PATENT DOCUMENTS

| | | | |
|---|---|---|---|
| 3,374,449 | 3/1968 | Moore et al. | 200/51.07 X |
| 3,378,797 | 4/1968 | Caputo | 200/16 B |
| 3,474,198 | 10/1969 | Conrad | 200/16 B |

*Primary Examiner*—Thomas J. Kozma

*Attorney, Agent, or Firm*—Mallinckrodt & Mallinckrodt

[57] ABSTRACT

An electrical connector-switch for use underwater is in two halves. Each half includes a tubular casing to which respective external electrical leads are connected, for a power supply to one half and an output from the other half. Each half also includes a core. The two casings can be joined together and the two cores joined together end-to-end, so that the two cores can slide as one member within the two casings for switching purposes. Electrical contacts on one of the cores switchably interconnect the external leads of the two casings in one end position of the two cores. Seals between the cores and the casings keep the water out, both when the casings and cores are joined together and when they are not joined together, so that connection and disconnection and switching are all possible underwater.

24 Claims, 7 Drawing Figures

ELECTRICAL CONNECTOR AND SWITCH APPARATUSES

FIELD OF THE INVENTION

This invention relates to electrical connector and switch apparatuses.

A particular application of the invention is to electrical connector and switch apparatus for use underwater or in some other environment which is hostile as regards use of electricity, for example in a flammable atmosphere.

SUMMARY OF THE INVENTION

According to the invention there is provided an electrical connector and switch apparatus comprising:

first and second operating members disconnectably connected, or adapted to be disconnectably connected, together in end-to-end relationship;

first and second tubular housings disconnectably connected, or adapted to be disconnectably connected, together in end-to-end relationship;

the two operating members and two housings, when respectively connected together, being adapted for the two operating members to be capable of relative switching movement as a single unit in the two housings;

at least said first operating member and at least said second housing each having an electrical contact such that, when the two operating members and the two housings are respectively connected together, electrical connection can be selectively made or broken between said contacts by relative switching movement of the two operating members in the two housings;

the two operating members and the two housings being adapted for said first and second operating members respectively to occupy said first and second housings when the two operating members and the two housings are respectively disconnected;

sealing means to seal the apparatus against fluid or other matter from the environment of the apparatus reaching any of the contacts both when the operating members and housings are respectively connected together and when they are disconnected;

and means to make an external connection to the electrical contact of said second housing.

Preferably the first housing is fitted with a sealing member to provide a seal between the ends of the two housings when connected end-to-end.

The first operating member and/or the second operating member may have a passage therealong.

Preferably the first or second operating member is provided with a seal for sealing the housings from fluid or other matter reaching any of the contacts via the or each passage when the housings and operating members are connected together.

Each housing and/or each operating member may either comprise resilient insulating material forming a coating layer or comprise rigid insulating material.

The housings may be disconnectably connectable together by means of either bolts or a bayonet joint.

The sealing means may comprise sealing rings housed in respective annular grooves on each operating member and/or in each housing.

In case a coating layer of resilient insulating material is used as mentioned above, said sealing means may comprise annular protuberances formed by the coating layer.

DESCRIPTION OF SPECIFIC EMBODIMENTS

Figure 1:
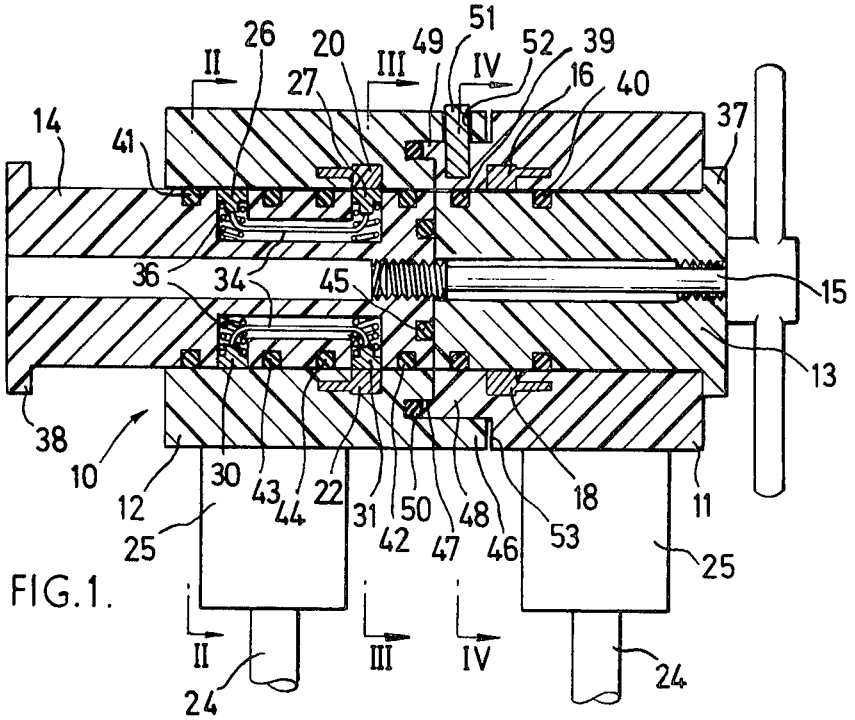
FIG. 1 shows a diagrammatic longitudinal section of a first electrical connector and switch apparatus embodying the invention.
Figure 2:
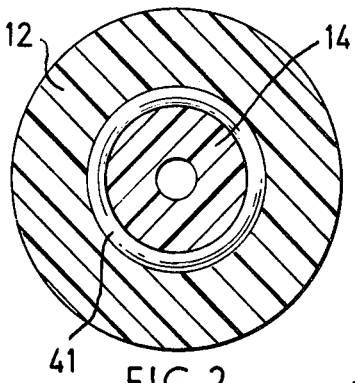
FIG. 2 is a section along the line II—II of FIG. 1.
Figure 3:
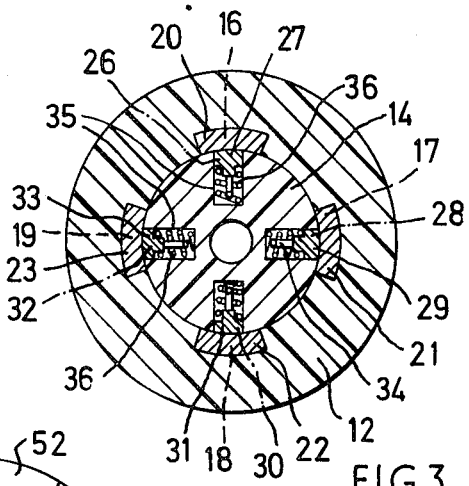
FIG. 3 is a section along the line III—III of FIG. 1.

Referring to FIGS. 1 to 4, the electrical connector and switch apparatus 10 illustrated therein comprises two tubular housings 11 and 12 detachably secured together in end-to-end relationship by means of a bayonet joint, which will be described in detail later. Two cylindrical operating members 13 and 14, detachably secured together in end-to-end relationship by means of an axial bolt 15, are mounted within housings 11 and 12 for longitudinal sliding movement relative to housings 11 and 12.

The housings 11 and 12 and the operating members 13 and 14 are made of rigid insulating material such as synthetic resin.

Four segment-shaped and equally spaced fixed contacts 16 to 19 are provided on the internal surface of housing 11 and embedded in the insulating material; four other similarly spaced and shaped fixed contacts 20 to 23 are provided on the internal surface of housing 12 and embedded in the insulating material.

Each of said fixed contacts 16 to 23 is connected to a lead extending outside housings 11 and 12 for connection to a respective cable 24 (only two of said cables being shown in FIG. 1) detachably mounted on the respective housing through a respective cable gland 25.

Four equally spaced pairs of interconnected contacts 26 and 27, 28 and 29, 30 and 31, and 32 and 33, are provided on the cylindrical surface of operating member 14. The contacts of each of said pairs of contacts are aligned along a generatrix of the external cylindical surface of operating member 14 and at a distance from each other equal to that existing between each of fixed contacts 16 to 19 and the corresponding fixed contact from among 20 to 23, so that, by longitudinally moving operating members 13 and 14 relative to housings 11 and 12, to effect switching, connection between each of contacts 16 to 19 on the one hand and the corresponding contact from among 20 to 23 can be selectively made or broken.

In order to simplify the making and breaking of said connections, the range of longitudinal movement of operating members 13 and 14 relative to housings 11 and 12 is limited by two flanges 37 and 38 integral with operating members 13 and 14 respectively and arranged at the opposite longitudinal ends thereof, the distance between flanges 37 and 38 being equal to the length of the assembled housings 11 and 12 plus the distance between the contacts of each of said pairs of interconnected contacts.

The contacts of each of said pairs of contacts are interconnected by a respective wire 34 embedded in the insulating material of operating member 14. Each contact 26 to 33 is slidably mounted in a respective radial recess 35 provided in the insulating material of operating member 14, and is biased towards the outside of said respective radial recess 35 by a respective spring 36.

Two annular sealing elements 39 and 40, preferably consisting of O-rings, are housed in respective annular grooves provided on the external cylindrical surface of operating member 13. Two annular sealing elements 41 and 42 preferably consisting of O-rings, are housed in respective annular grooves on the external cylindrical surface of operating member 14 which, as shown in FIG. 1, is provided with two other annular grooves accommodating respective annular sealing elements 43 and 44. However, sealing elements 43 and 44 are optional. A further sealing element 45, which may be either an O-ring or a flat seal, is housed in a respective annular control groove provided on a flat end surface of operating member 14, facing operating member 13.

The end of housing 12 facing housing 11 is provided with an annular extension 46 extending axially from the external periphery of said end surface, and an annular frontal groove 47 adjacent to extension 46. The extremity of housing 11 facing housing 12 consists of a restricted annular portion 48 fitting within annular extension 46 of housing 12 and in contact with said end surface of housing 12. Annular portion 48 is provided with an annular extension 49 extending axially from the external periphery of the free-end surface of annular portion 48. Annular extension 49 fits within frontal groove 47 and abuts against a sealing element 50 housed in groove 47. Sealing element 50 may be either an O-ring or a frontal seal.

Figure 4:
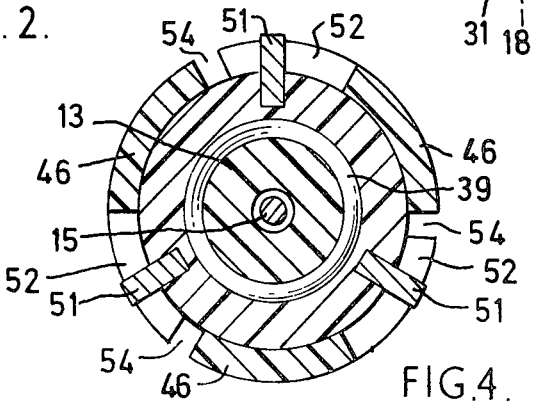
FIG. 4 is a section along the line IV—IV of FIG. 1.

As said above and as shown in FIGS. 1 and 4, housings 11 and 12 are detachably connected to each other by means of a bayonet joint which comprises a plurality of pins 51 radially extending from the external cylindrical surface of annular portion 48 of housing 11 and secured thereto and a plurality of respective slots 52 provided in the annular extension 46 of housing 12. Each slot 52 extends circumferentially along annular extension 46 and is slightly inclined relative to the annular end surface 53 of annular extension 46. Each slot 52 opens onto surface 53 via an axial opening 54 allowing the insertion of the respective pin 51.

Figure 5:
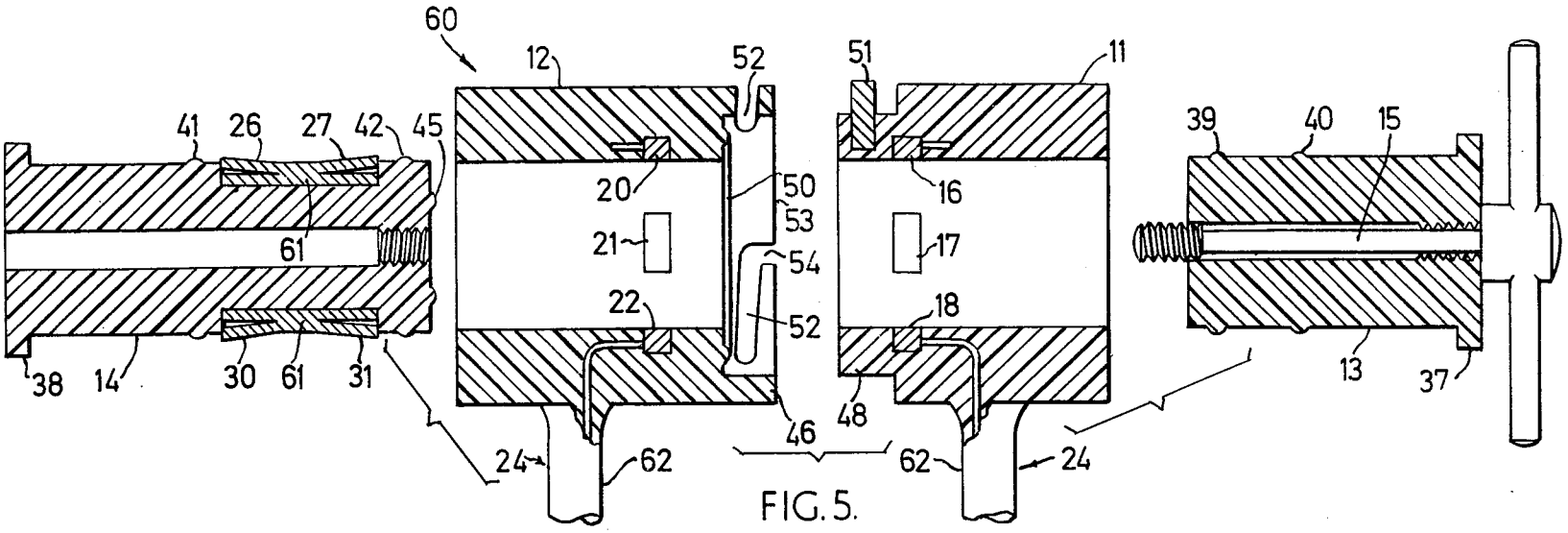
FIG. 5 shows a diagrammatic exploded longitudinal section of a second electrical connector and switch apparatus embodying the invention.
Figure 7:
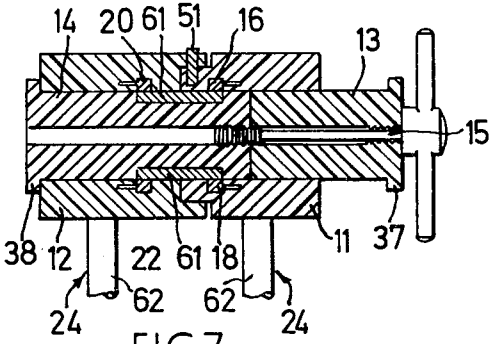
FIGS. 6 and 7 are longitudinal sections of the apparatus of FIG. 5 in two different operational positions.
Figure 6:
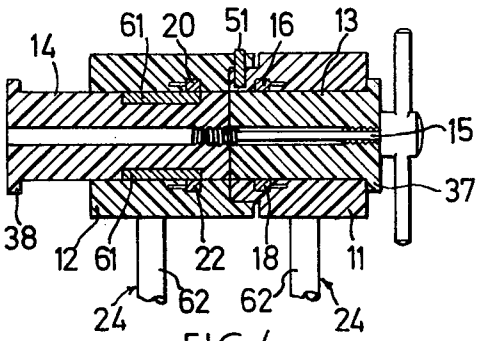

FIGS. 5 to 7 show an electrical connector and switch apparatus 60 which is very similar to apparatus 10 shown in FIGS. 1 to 4 and the same reference numbers will be used for corresponding parts.

Like apparatus 10, apparatus 60 (see FIG. 5) comprises two tubular housings 11 and 12 of insulating material, detachably secured together in end-to-end relationship by means of a bayonet joint; two cylindrical operating members 13 and 14 also of insulating material detachably secured together in end-to-end relationship by means of an axial bolt 15 for longtudinal relative sliding movement thereof within housings 11 and 12 and provided with stop flanges 37 and 38 respectively; segment-shaped fixed contacts 16 to 19 (only contacts 16 to 18 being shown in FIG. 5) and 20 to 23 (only contacts 20 to 22 being shown in FIG. 5) on the inner surface of housings 11 and 12 respectively; a lead connected to each of said contacts 16 to 23 and leading to a respective external cable 24; four pairs of interconnected contacts 26 and 27, 28 and 29; 30 and 31, and 32 and 33 (only pairs 26 and 27 and 30 and 31 being shown in FIG. 5) on operating member 14 engageable with said fixed contacts 16 to 23 for selective making and breaking of connections beween each of contacts 16 to 19 on the one hand and a respective contact from among 20 to 23 on the other hand; annular sealing elements 41 and 42 on operating member 14; a frontal sealing element 45 on the end surface of operating member 14 facing operating member 13; annular sealing elements 39 and 40 on operating member 13; and a frontal sealing element 50 on the extremity of housing 12 facing housing 11.

As for apparatus 10, the bayonet joint of apparatus 60 comprises a plurality of pins 51 radially extending from an annular end portion 48 of housing 11 and engaged into respective slots 52 extending circumferentially on an annular extension 46 of housing 12 and opening onto an end surface 53 of said extension 46 with respective openings 54 allowing the insertion of the respective pins 51.

The main difference between apparatuses 10 and 60 is that, while housings 11 and 12 and operating members 13 and 14 of apparatus 10 are made of rigid insulating material, the corresponding parts of apparatus 60 are made of resilient insulating material, such as rubber, and this involves many difference between the designs of apparatuses 10 and 60.

For example, the sealing elements 39 to 42, 45 and 50 do not consist of O-rings or the like, but of resilient annular protuberances integral with the respective housing or operating member end made of said resilient insulating material, said protuberances being formed when moulding said housings and operating members.

Owing to the fact that sealing element 50 is an annular protuberance there is no need for apparatus 60 to be provided with annular extension 49 and corresponding groove 47 present in apparatus 10.

Another difference between apparatuses 10 and 60 is that, while in apparatus 10 the interconnected contacts 26 to 33 are spring-biased contacts interconnected in pairs by wires 34, the corresponding interconnected contacts of apparatus 60 are self-biased spring contacts, each pair of said interconnected contacts comprising a conductive segment 61 embedded in the insulating material of operating members 14 and rigid with two elastic lips forming the two interconnected contacts and springing outwardly from the centre of segment 61 in opposite directions.

A final difference between apparatuses 10 and 60 is that, while in apparatus 10 cables 24 are detachably connected to the respective housings 11, 12 via cable glands 25, in apparatus 60 cables 24 are fixed to the respective housings 11, 12 by moulding together the material of said housings and a respective sheath 62 of said cables.

The operation of electrical connection and switch apparatuses 10 and 60 is shown in FIGS. 6 and 7 with reference to apparatus 60.

In FIG. 6, flange 37 is arranged in contact with the free end of housing 11; in this position the fixed contacts 16 to 19 are disconnected from the respective fixed contacts 20 to 23. By moving operating members 13 and 14 to the right of FIG. 6, the position shown in FIG. 7 is reached in which flange 38 is arranged in contact with the free end of housing 12. In this position the interconnected pairs of contacts 26 to 33 form conductive bridges between the fixed contacts 16 to 19 and the respective fixed contacts 20 to 23.

Owing to sealing elements 39 to 42, 45 and 50, contacts 16 to 23 and 26 to 33 are protected from ingress of fluid or other matter from the environment of the apparatus both when housings 11 and 12 and operating members 13 and 14 are separately secured together in said end-to-end relationship, and when housings 11 and 12 and operating members 13 and 14 are respectively detached with each operating member 13, 14 within a respective housing 11 or 12.

The preferred embodiments of the invention described above may of course be modified in a number of ways without thereby exceeding the scope of the invention. For example, a modified electrical connector and switch assembly may have more than two housings and/or more than two operating members. The fixed and spring contacts may differ in number and arrangement from those shown in the drawings. The fixed contacts may be replaced by spring contacts and/or the spring contacts may be replaced by fixed contacts. The housings may be connected by axial bolts instead by a bayonet joint or, where more than two housings are used, both types of connection may be used. The housings and operating members need not be completely made of insulating material, said insulating material being necessary only to insulate the contacts and the leads from electrical dispersion to the environment surrounding the assembly.

If a resilient insulating material is used, said material may form only a coating layer housing the contacts and extended only to the surfaces on which a sealing annular protuberance is needed. Also when using a resilient insulating material, all or only some sealing elements may consist of 0-rings or the like, and finally, the sealing elements which, as shown in FIGS. 1 and 5, are provided on the cylindrical surfaces of the operative members, may be provided on the inner surfaces of the housings.

All the above modifications may be present singly or in different combinations.

It will be observed that the operating members 13 and 14 fill substantially all of the space inside the housings 11 and 12.

What is claimed is:

1. An electrical connector and switch apparatus comprising:

first and second operating members including means whereby the operating members are adapted to be disconnectably connected together in end-to-end relationship;

first and second tubular housings including means whereby the housings are adapted to be disconnectably connected together in end-to-end relationship;

the two operating members and two housings, when respectively connected together, being adapted for the two operating members to be capable of relative switching movement as a single unit in the two housings;

at least said first operating member and at least said second housing each having an electrical contact such that, when the two operating members and the two housings are respectively connected together, electrical connection can be selectively made and broken between said contacts by relative switching movement of the two operating members in the two housings;

the two operating members and the two housings being adapted for said first and second operating members respectively to occupy said first and second housings when the two operating members and the two housings are respectively disconnected;

sealing means to seal the apparatus against fluid or other matter from the environment of the apparatus reaching any of the contacts both when the operating members and housings are respectively connected together and when they are disconnected;

and means to make an external electrical connection to the electrical contact of said second housing.

2. An electrical connector and switch assembly as claimed in claim 1, wherein said first housing has an electrical contact such that, when the two operating members and the two housings are respectively connected together, electrical connection can be selectively made and broken between said electrical contact of said first housing and an electrical contact of one of the operating members by relative switching movement of the two operating members in the two housings, and wherein an external electrical connection can be made to said electrical contact of said first housing.

3. An electrical connector and switch assembly as claimed in claim 1 wherein said first and second operating members fill substantially all of said first and second housings respectively when said operating members and housings are respectively disconnected.

4. An electrical connector and switch apparatus as claimed in claim 1 wherein the first housing is fitted with a sealing member to provide a seal between the ends of the two housings when connected end-to-end.

5. An electrical connector and switch apparatus as claimed in claim 1 wherein the first operating member has a passage therealong.

6. An electrical connector and switch apparatus as claimed in claim 1 wherein the second operating member has a passage therealong.

7. An electrical connector and switch apparatus as claimed in claim 5 wherein the first operating member is provided with a seal for sealing the apparatus against fluid and other matter reaching any of the contacts via the passage.

8. An electrical connector and switch apparatus as claimed in claim 1 wherein the means whereby the housings can be disconnectably connected together is a bayonet joint.

9. An electrical connector and switch apparatus as claimed in claim 1 wherein each housing is made of rigid insulating material.

10. An electrical connector and switch apparatus as claimed in claim 1 wherein each housing is made of resilient insulating material.

11. An electrical connector and switch apparatus as claimed in claim 1 wherein each operating member is made of rigid insulating material.

12. An electrical connector and switch apparatus as claimed in claim 1 wherein each operating member is made of resilient insulating material.

13. An electrical connector and switch apparatus as claimed in claim 1 wherein said sealing means comprises a plurality of sealing rings housed in respective annular grooves on each operating member.

14. An electrical connector and switch apparatus as claimed in claim 1 wherein said sealing means comprises a plurality of sealing rings housed in respective annular grooves in each housing.

15. An electrical connector and switch apparatus as claimed in claim 11 wherein said sealing means comprises annular protuberances formed by the resilient insulating material.

16. An electrical connector and switch apparatus as claimed in claim 13 wherein said sealing means comprises annular protuberances formed by the resilient insulating material.

17. An electrical connector and switch apparatus as claimed in claim 1 wherein said electrical contacts include spring contacts.

18. An electrical connector and switch apparatus as claimed in claim 17 wherein said spring contacts are spring-biased contacts.

19. An electrical connector and switch apparatus as claimed in claim 17, wherein said spring contacts are self-biased spring contacts.

20. An electrical connector and switch apparatus as claimed in claim 1 wherein a lead from the electrical contact of said second housing is connected to a respective cable fixed and sealed to said second housing by moulding together the material of said housing and a sheath of said cable.

21. An electrical connector and switch apparatus as claimed in claim 1 wherein a lead from the electrical contact of said second housing is connected to a respective cable detachably mounted on said second housing through a respective cable gland.

22. An electrical connector and switch assembly as claimed in claim 2 wherein said first and second operating members fill substantially all of said first and second housings respectively when said operating members and housings are respectively disconnected;

wherein the first housing is fitted with a sealing member to provide a seal between the ends of the two housings when connected end-to-end;

wherein the first operating member has a passage therealong;

wherein the second operating member has a passage therealong;

wherein the first operating member has an inner end face which is provided with a seal which is engageable with the second operating member for sealing the apparatus against fluid or other matter reaching any of the contacts via either passage when the housings and operating members are connected together; and wherein the means whereby the housings can be disconnectably connected together is a bayonet joint.

23. An electrical connector and switch apparatus as claimed in claim 22 wherein each housing is made of rigid insulating material;

wherein each operating member is made of rigid insulating material;

wherein said sealing means comprises a plurality of sealing rings housed in respective annular grooves on each operating member and in each housing;

wherein said electrical contacts comprise spring-biased contacts; and wherein a lead from the electrical contact of said second housing is connected to a respective cable detachably mounted on said second housing through a respective cable gland.

24. An electrical connector and switch apparatus as claimed in claim 22 wherein each housing is made of resilient insulating material;

wherein each operating member is made of resilient insulating material;

wherein each sealing means comprises annular protruberances formed by the resilient insulating material of one of the housings and of one of the operating members;

wherein said electrical contacts comprise self-biased spring contacts; and wherein a lead from the electrical contact of said second housing is connected to a respective cable fixed and sealed to said second housing by moulding together the material of said second housing and a sheath of said cable.

* * * * *